US011525303B2

(12) United States Patent
West et al.

(10) Patent No.: US 11,525,303 B2
(45) Date of Patent: Dec. 13, 2022

(54) CEILING TILE LADDER ATTACHMENT DEVICE

(71) Applicants: Jackie West, East Moline, IL (US); Nancy West, East Moline, IL (US)

(72) Inventors: Jackie West, East Moline, IL (US); Nancy West, East Moline, IL (US)

(73) Assignees: Jackie West, East Moline, IL (US); Nancy West, East Moline, IL (US)

( * ) Notice: Subject to any disclaimer, the term of this patent is extended or adjusted under 35 U.S.C. 154(b) by 0 days.

(21) Appl. No.: 17/496,492

(22) Filed: Oct. 7, 2021

(65) Prior Publication Data

US 2022/0025706 A1 Jan. 27, 2022

Related U.S. Application Data

(63) Continuation-in-part of application No. 16/900,325, filed on Jun. 12, 2020, now abandoned.

(60) Provisional application No. 62/877,650, filed on Jul. 23, 2019.

(51) Int. Cl.

| | |
|---|---|
| ***E06C 7/16*** | (2006.01) |
| ***E06C 7/14*** | (2006.01) |
| ***E04F 21/18*** | (2006.01) |

(52) U.S. Cl.

CPC ..... *E06C 7/146* (2013.01); *E04F 21/18* (2013.01); *E06C 7/14* (2013.01); *E06C 7/16* (2013.01); *E06C 7/165* (2013.01)

(58) Field of Classification Search

CPC . E06C 7/146; E06C 7/14; E06C 7/143; E06C 7/16; E06C 7/165; E04F 21/18; E04G 5/003; E04G 5/00; A47F 5/00; B62B 3/102; B62B 3/18; B62B 3/14; B62B 3/1472

USPC ..... 248/210, 215, 211, 238, 312, 249; 211/117–119, 106

See application file for complete search history.

(56) References Cited

U.S. PATENT DOCUMENTS

| | | | | |
|---|---|---|---|---|
| 1,284,579 | A | | 11/1918 | Brown |
| 2,305,863 | A | * | 12/1942 | Ginter ..... B65B 67/1227 248/100 |
| 2,498,446 | A | | 2/1950 | Pawsat |
| 2,589,564 | A | | 3/1952 | Moore |
| 2,659,420 | A | | 11/1953 | Edward |
| 2,659,917 | A | | 11/1953 | Drum |
| 2,904,237 | A | | 9/1959 | Joseph |
| 2,911,133 | A | | 11/1959 | Ruggieri |
| 3,175,743 | A | | 3/1965 | Richard |
| 3,268,133 | A | | 8/1966 | Mcanallen |

(Continued)

*Primary Examiner* — Nkeisha Smith

(74) *Attorney, Agent, or Firm* — Hamilton IP Law, PC; Jay R. Hamilton; Charles A. Damschen

(57) ABSTRACT

The ceiling tile ladder attachment device holds ceiling tiles while a user is working on a ladder to install or replace the tiles in the ceiling, in addition to storing tiles that have to be removed from the ceiling and held for re-installation after performing other maintenance above the tiles. The ceiling tile ladder attachment device includes a rectangular wire rack that attaches to the back side of a ladder. The wire rack has a hook part on the back side. The hook part preferably attaches to the wire rack in two places to prevent the wire rack from swinging or slipping on the ladder. The hook part includes adjustable hook points for different styles and sizes of step ladders. The user can attach the ceiling tile ladder attachment device to the backside of the ladder using the hook part.

11 Claims, 5 Drawing Sheets

(56) References Cited

U.S. PATENT DOCUMENTS 3,489,385 A 1/1970 Dill, Jr.
3,995,803 A 12/1976 Uitz
4,376,502 A * 3/1983 Cohen ..... B62B 3/1464 224/547
4,403,807 A * 9/1983 Wilkinson ..... A47D 13/025 297/188.1
4,480,810 A 11/1984 Hall
4,672,703 A 6/1987 Frazier
4,712,692 A 12/1987 Peinsipp
4,730,758 A 3/1988 McMurtrey
4,765,495 A * 8/1988 Bisk ..... A47F 5/13 24/336
4,813,535 A 3/1989 Radocha et al.
4,947,961 A 8/1990 Dudley
4,960,214 A 10/1990 Sayers
5,052,581 A 10/1991 Christ et al.
5,356,061 A 10/1994 Yu
5,362,077 A * 11/1994 Adamson ..... B62B 3/1472 224/567
5,493,751 A * 2/1996 Misiukowiec ..... E06C 7/146 D32/53.1
5,875,902 A * 3/1999 Emery ..... A47B 96/16 108/29
6,102,218 A * 8/2000 Alfonso ..... A47B 96/061 248/303
6,131,699 A * 10/2000 Leak, Jr. ..... E06C 7/14 248/238
6,341,704 B1 * 1/2002 Michel, Jr. ..... A47L 19/04 211/119.011
6,412,601 B1 7/2002 Schmidt
6,520,351 B1 2/2003 Zadro
7,000,876 B2 * 2/2006 Searcy ..... E06C 7/14 248/210
7,802,709 B1 9/2010 Lewis et al.
8,371,548 B1 2/2013 Bishop
9,199,656 B1 12/2015 Tong et al.
10,040,468 B2 * 8/2018 Bacallao ..... B62B 3/1468
10,112,637 B2 10/2018 Campbell et al.
10,173,708 B1 1/2019 Bacallao
10,443,305 B2 10/2019 Johnsen
10,507,859 B2 * 12/2019 Bacallao ..... B65B 67/1227
10,718,120 B1 * 7/2020 Haney ..... E04G 5/003
2001/0007343 A1 7/2001 McElhaney
2003/0010736 A1 * 1/2003 Hope ..... D06F 58/04 211/90.03
2006/0102424 A1 * 5/2006 Wise ..... E06C 7/146 182/129
2006/0231333 A1 * 10/2006 Proulx ..... E06C 7/146 182/107
2006/0255217 A1 * 11/2006 Wise ..... E06C 7/146 248/153
2011/0079467 A1 * 4/2011 Mares ..... E06C 7/14 182/129
2016/0096542 A1 4/2016 Fukushima
2018/0009460 A1 1/2018 Bacallao et al.

* cited by examiner

CEILING TILE LADDER ATTACHMENT DEVICE

CROSS-REFERENCE TO RELATED APPLICATION

The present application is a continuation-in-part application and claims priority from U.S. patent application Ser. No. 16/900,325 filed on Jun. 12, 2020, which patent application was related to and claimed priority from prior provisional application Ser. No. 62/877,650, filed Jul. 23, 2019, both of which applications are incorporated herein by reference in their entireties.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CPR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

Field of the Invention

The present invention relates generally to the field of ladder attachments. More specifically, the invention is ceiling tile holder that is easily attachable to a wide variety and sizes of ladders and safely holds a number of ceiling tiles so that they can be installed quickly and without damage.

Description of the Related Art

The ceiling is an important aspect contributing to the aesthetic appeal of a room. Installing ceiling tiles is a common way of improving the aesthetics of a ceiling, and thereby the entire room. When a ceiling tile breaks, or is otherwise damaged by water, insects, etc., it is usually easier to replace the ceiling tile rather than attempt a repair. Often, multiple ceiling tiles need replaced, but can only be installed one at a time. This requires the worker to climb up and down the ladder to retrieve and place each tile, or attempt to balance the tiles on the top of the ladder, where they may easily be knocked off and broken. A more efficient and reliable way is needed.

Ideally, a ceiling tile ladder attachment device should provide a secure place to store a group of ceiling tiles on the ladder while attaching to a wide range of ladder types and sizes, yet would operate reliably and be manufactured at a modest expense. Thus, a need exists for a reliable ceiling tile ladder attachment device to avoid the above-mentioned problems.

SUMMARY OF THE PRESENT DISCLOSURE

In view of the foregoing disadvantages inherent in the known ladder attachment art, the present invention provides a novel ceiling tile ladder attachment device. The general purpose of the present invention, which will be described subsequently in greater detail, is to provide a secure place to store a group of ceiling tiles on a ladder where they can easily be reached by a person at the top of the ladder for installation.

The present invention relates to ladder attachments. More particularly, the present invention relates to a ceiling tile ladder attachment device. The ceiling tile ladder attachment device provides the user with an easy-to-install rack that conveniently hooks on to the backside of a ladder and holds approximately 8-10 ceiling tiles. The hooks are adjustable to accommodate different style and size ladders.

The ceiling tile ladder attachment device allows ceiling tiles to be installed with equally efficiency and convenience to the installer at home, hospitals, schools, office buildings, or anywhere else. Having the ceiling tiles in the basket saves the user time as the user is no longer required to climb up and down a ladder to retrieve ceiling tiles or risk knocking them off the top of the ladder and breaking them before they are even installed.

The present invention holds significant improvements and serves as a ceiling tile ladder attachment device. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention that are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures that accompany the written portion of this specification illustrate embodiments and method(s) of use for the present invention, a ceiling tile ladder attachment device, constructed and operative according to the teachings of the present invention.

The various embodiments of the present invention will hereinafter be described in conjunction with the appended drawings, wherein like designations denote like elements.

As discussed above, embodiments of the present invention relate to a ladder attachment. More specifically, the invention is ceiling tile holder that is easily attachable to a wide variety and sizes of ladders and safely holds a number of ceiling tiles so that they can be installed quickly and without damage.

Generally speaking, the presently claimed invention will hold ceiling tiles while user is working on a ladder to install or replace the tiles in the ceiling, in addition to storing tiles that have to be removed from the ceiling and held for re-installation after performing other maintenance above the tiles.

Figure 1:
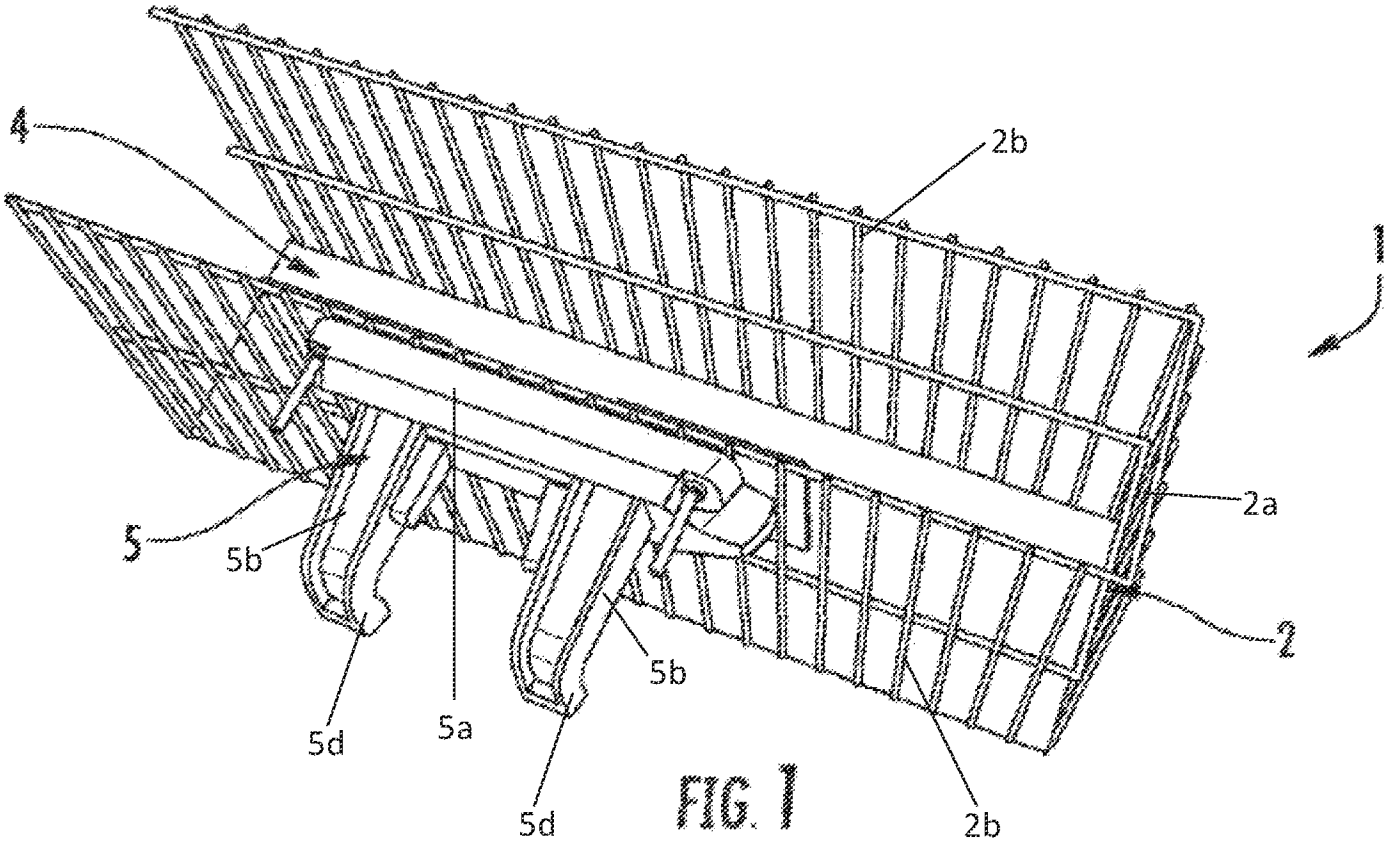
FIG. 1 shows a back perspective view illustrating a ceiling tile ladder attachment device according to an embodiment of the present invention.
Figure 2:
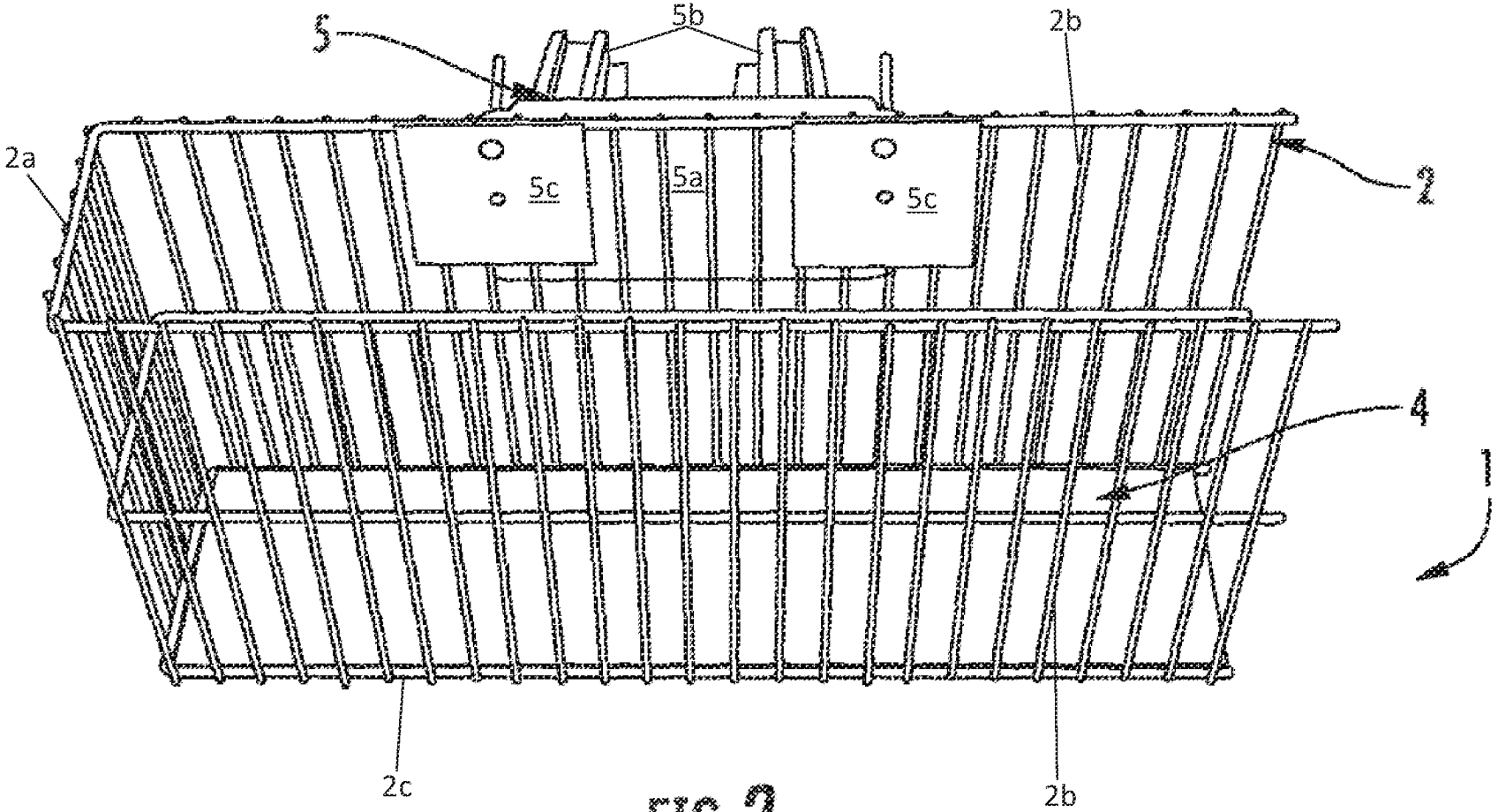
FIG. 2 is a front perspective view illustrating a ceiling tile ladder attachment device according to an embodiment of the present invention of FIG. 1.
Figure 3:
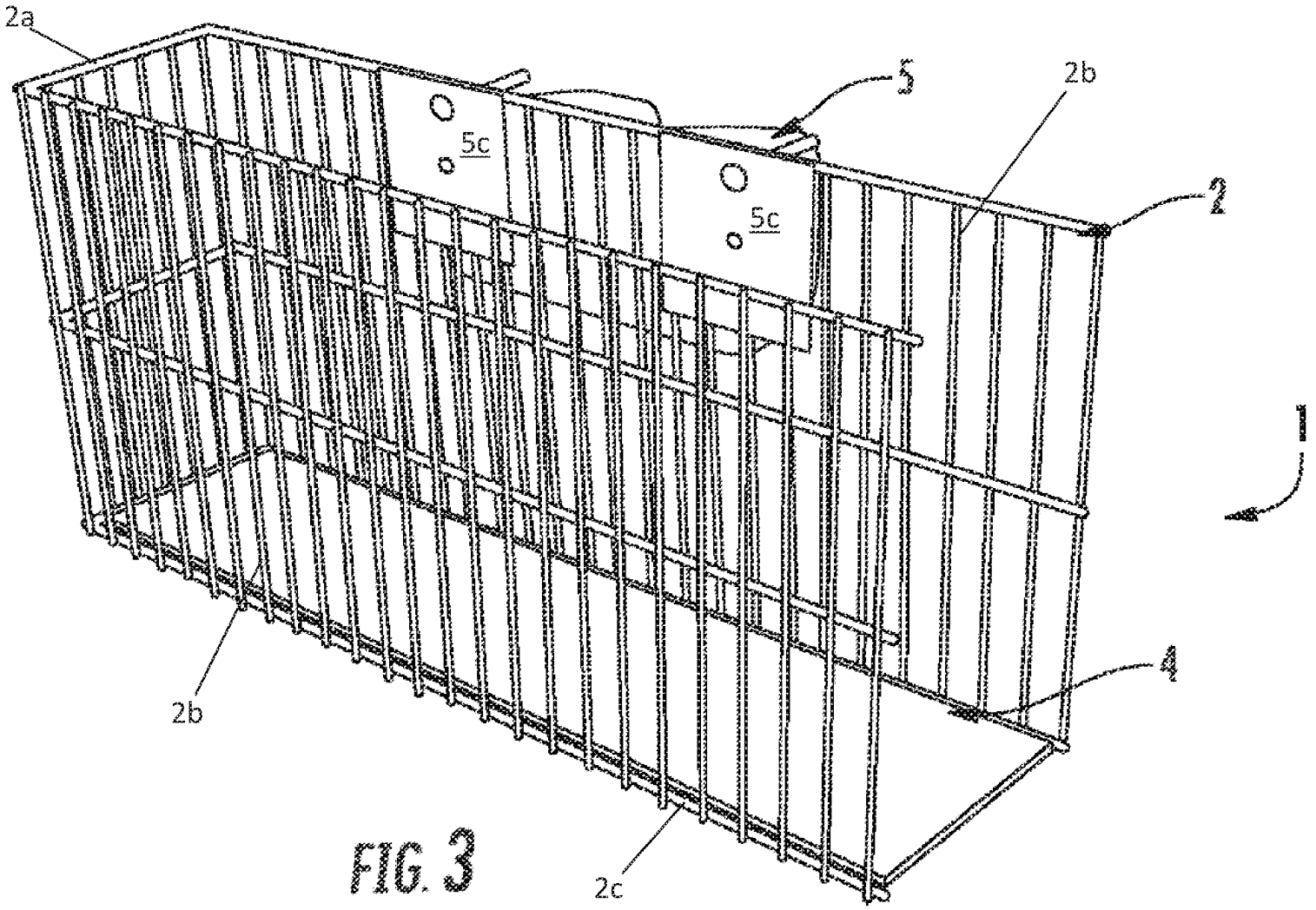
FIG. 3 is a side perspective view illustrating a ceiling tile ladder attachment device according to an embodiment of the present invention of FIG. 1.
Figure 4:
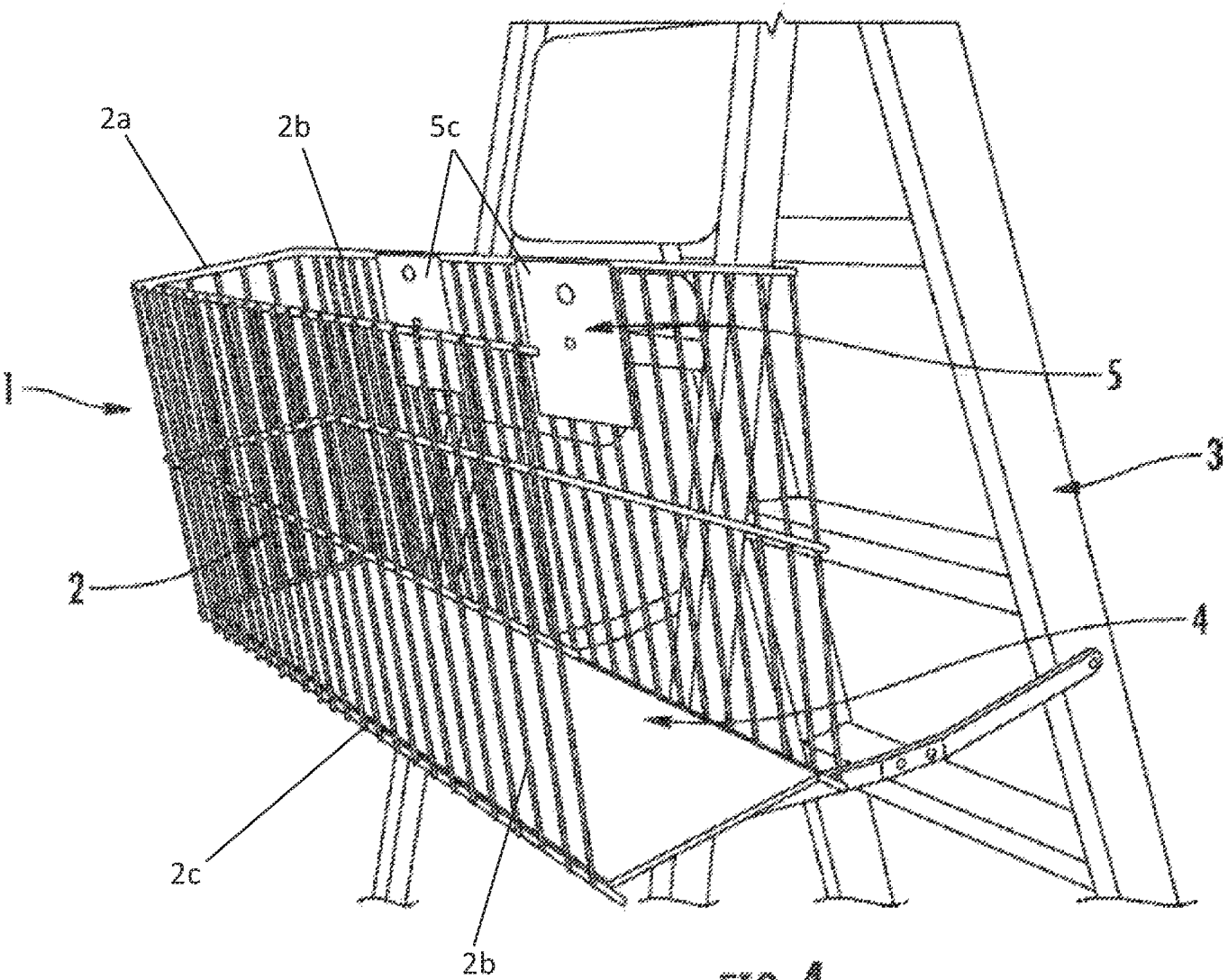
FIG. 4 is a side perspective view illustrating a ceiling tile ladder attachment device attached to a ladder according to an embodiment of the present invention of FIG. 1.
Figure 5:
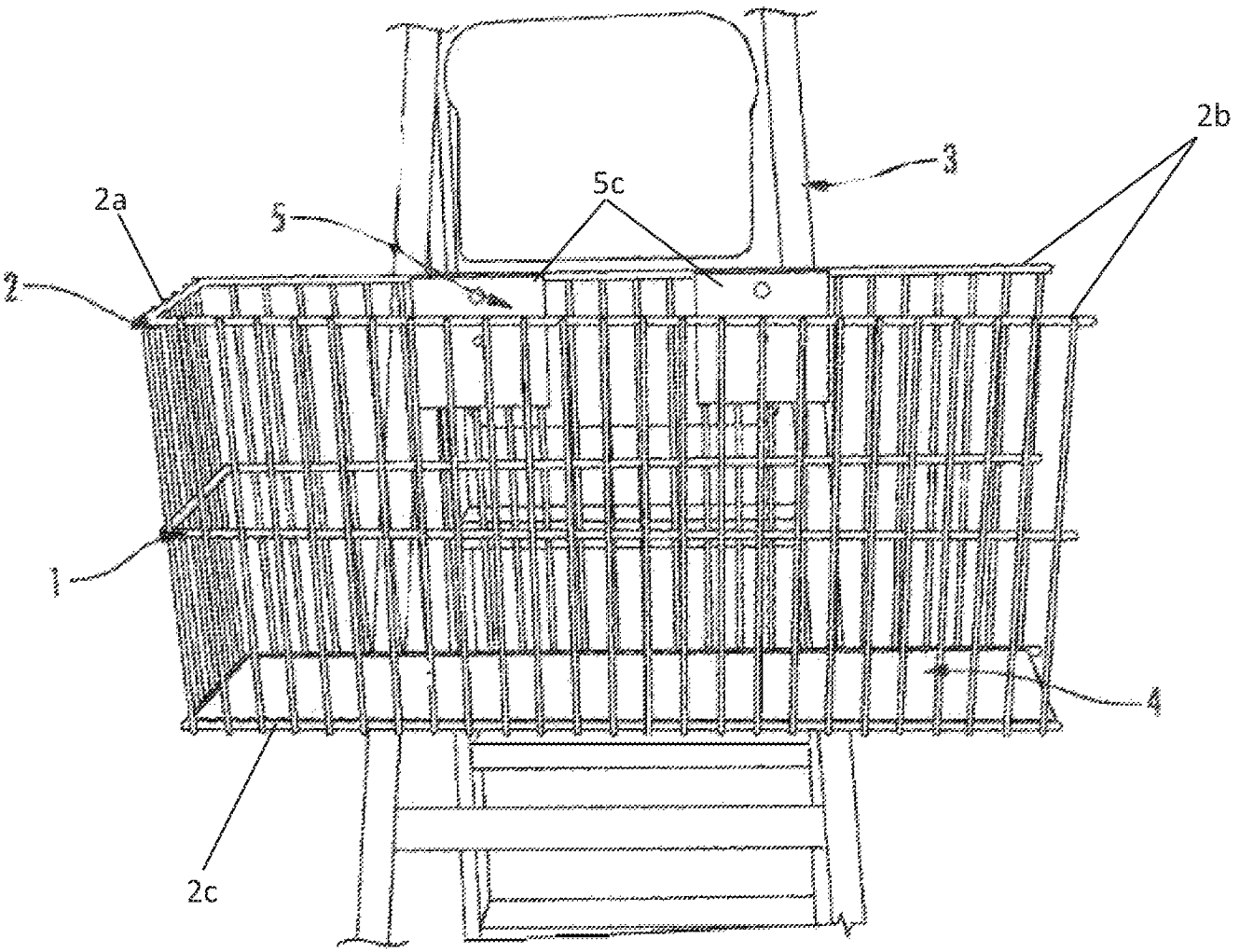
FIG. 5 is a front perspective view illustrating a ceiling tile ladder attachment device attached to a ladder according to an embodiment of the present invention of FIG. 1.

As shown in FIGS. 1-5, the ceiling tile ladder attachment device 1 includes a rectangular wire rack 2 that attaches to the back side of a ladder 3. The wire rack 2 can be any suitable dimensions but is preferably wide enough to hold up to six tiles 4. The tiles 4 may be entirely within the wire basket 2 or may extend out the open top of the wire basket 2. The wire rack 2 also preferably is two feet long in an illustrative embodiment. The wire rack 2 may include a side piece 2*a* with two length pieces 2*b* extending therefrom, wherein the two length pieces 2*b* may be generally parallel with one another. The wire rack 2 may also include a base piece 2*c*, which may form the bottom of the wire rack 2 and be connected to the side piece 2*a* and both length pieces. Accordingly, and as shown at least in the various figures, the rack 2 may be configured as a rectangular-shaped basket wherein one end (i.e., the end opposite the side piece 2*a*) between the two length pieces 2*b* may be left open to provide easier access to tiles 4 positioned within the wire rack 2. The wire rack 2 is preferably made of metal and may have a plastic or rubber coating.

The wire rack 2 has a hook part 5 on the back side. The hook part 5 preferably attaches to the wire rack in two places to prevent the wire rack 2 from swinging or slipping on the ladder 3. The hook part 5 includes a backing part 5*a* engaged along a portion of the exterior surface of one of the length pieces 2*b* of the wire rack 2. Two attachment parts 5*c* may be engaged with the backing part 5*a* on opposite ends of the backing part 5*a* and on the interior surface of the length piece 2*b* with which the backing part 5*a* is engaged. Two adjustable hooks 5*b* may extend outward from the backing part 5*a* away from the wire rack 2 and may terminate at a hook point 5*d* on a distal end of each adjustable hook 5*b*. The hooks 5*b* may be positioned at various points along the length of the backing part 5*a* such that the distance between the hooks 5*b* may be varied to accommodate ladders 3 of different widths. In an illustrative embodiment, the hooks 5*b* may be engaged with the backing part 5*a* via a mechanical fastener, which mechanical fastener may also engage one of the attachment parts 5*c*. However, any suitable structure and/or method may be used to allow for a variable distance between the hooks 5*b* and selective engagement of the hooks 5*b* with the backing part 5*a* and/or attachment part(s) 5*c* without limitation unless otherwise indicated in the following claims. Accordingly, the ceiling tile ladder attachment device 1 may provide multiple engagement points for different styles and/or sizes of step ladders 3. The user can attach the ceiling tile ladder attachment device 1 to the backside of the ladder 3 using the hook part 5 such that the ceiling tile ladder attachment device 1 may be supported via the hooks 5*b* of the hook part 5, and a portion of the wire rack 2 (which portion is shown adjacent an intersection between the bottom edge of the length piece 2*b* that is engaged with the backing part 5*a* and an edge of the base piece 2*c*) may simultaneously rest against a back side of the ladder 3 as to provide additional support/securement of the ceiling tile ladder attachment device 1 with respect to the ladder 3.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

While certain specific illustrative embodiments have been described in detail, it is understood that the present disclosure will be appreciated by those skilled in the art and will be developed considering the overall teaching of the disclosure. Accordingly, the embodiments disclosed herein should not be construed as limitation on the scope of the invention but should be determined by the appended claims and their legal equivalents.

It should be noted that particular embodiments are not limited to the specific illustrative embodiments pictured and described herein, but is intended to apply to all similar apparatuses and methods for providing the various benefits of those elements, which such benefits are explicitly and/or inherently disclosed herein. Modifications and alterations from the described embodiments will occur to those skilled in the art without departure from the spirit and scope of the ceiling tile ladder attachment device. Furthermore, variations and modifications of the foregoing are within the scope of the ceiling tile ladder attachment device. It is understood that the ceiling tile ladder attachment device as disclosed herein extends to all alternative combinations of one or more of the individual features mentioned, evident from the text and/or drawings, and/or inherently disclosed. All of these different combinations constitute various alternative aspects of the ceiling tile ladder attachment device. The embodiments described herein explain the best modes known for practicing the ceiling tile ladder attachment device and will enable others skilled in the art to utilize the same. The claims are to be construed to include alternative embodiments to the extent permitted by the prior art.

The materials used to construct the apparatuses and/or components thereof may vary depending on the specific application thereof, but it is contemplated that polymers, synthetic materials, metals, metal alloys, natural materials, and/or combinations thereof may be especially useful in some applications. Accordingly, the above-referenced elements may be constructed of any material known to those skilled in the art or later developed, which material is appropriate for the specific application of the present disclosure without departing from the spirit and scope of the present disclosure unless so indicated in the following claims.

Having described preferred aspects of the various methods and apparatuses, other features of the present disclosure will undoubtedly occur to those versed in the art, as will numerous modifications and alterations in the embodiments as illustrated herein, all of which may be achieved without departing from the spirit and scope of the present disclosure. Accordingly, the methods and embodiments pictured and described herein are for illustrative purposes only, and the scope of the present disclosure extends to all method and/or structures for providing the various benefits and/or features of the present disclosure and/or components thereof unless so indicated in the following claims. Furthermore, the methods and embodiments pictured and described herein are no way limiting to the scope of the present disclosure unless so stated in the following claims.

While various apparatuses and methods according to the present disclosure have been described in connection with preferred aspects and specific examples, it is not intended that the scope be limited to the particular embodiments and/or aspects set forth, as the embodiments and/or aspects herein are intended in all respects to be illustrative rather than restrictive. Accordingly, the processes and embodiments pictured and described herein are no way limiting to the scope of the present disclosure unless so stated in the following claims.

Although several figures are drawn to accurate scale, any dimensions provided herein are for illustrative purposes only and in no way limit the scope of the present disclosure unless so indicated in the following claims. It should be noted that the apparatuses and methods disclosed herein are not limited to the specific embodiments pictured and described herein, but rather the scope of the inventive features according to the present disclosure is defined by the claims herein. Modifications and alterations from the described embodiments will occur to those skilled in the art without departure from the spirit and scope of the present disclosure.

Any of the various features, components, functionalities, advantages, aspects, configurations, etc. for the present disclosure may be used alone or in combination with one another depending on the compatibility of the features. Accordingly, a nearly infinite number of variations of the present disclosure exists. Modifications and/or substitutions of one feature, component, functionality, aspect, configuration, etc. for another in no way limit the scope of the present disclosure unless so indicated in the following claims.

It is understood that the present disclosure extends to all alternative combinations of one or more of the individual features mentioned, evident from the text and/or drawings, and/or inherently disclosed. All of these different combinations constitute various alternative aspects of the present disclosure and/or components thereof. The embodiments described herein explain the best modes known for practicing the apparatuses, methods, and/or components disclosed herein and will enable others skilled in the art to utilize the same. The claims are to be construed to include alternative embodiments to the extent permitted by the prior art.

While the present disclosure has been described in connection with preferred aspects and specific examples, it is not intended that the scope be limited to the particular embodiments set forth, as the embodiments herein are intended in all respects to be illustrative rather than restrictive.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including but not limited to: matters of logic with respect to arrangement of steps or operational flow; plain meaning derived from grammatical organization or punctuation; the number or type of embodiments described in the specification.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

The invention claimed is:

1. A method of positioning a ceiling tile, said method comprising:

a. positioning said ceiling tile in a ceiling tile ladder attachment device;

b. engaging said ceiling tile ladder attachment device with a ladder, said ceiling tile ladder attachment device comprising:

i. a wire rack body, wherein said ceiling tile is positioned in said wire rack body, said wire rack body comprising:

1. a rectangular base piece;

2. a first length piece extending upward from said rectangular base piece on a first edge of said rectangular base piece;

3. a second length piece extending upward from said rectangular base piece on a second edge of said rectangular base piece, wherein said second edge is parallel to said first edge;

4. a side piece extending upward from said rectangular base pieces on a third edge of said rectangular base piece, wherein said third edge is perpendicular to said first and second edges; and, 5. an opening adjacent a fourth edge of said rectangular base piece, wherein said fourth edge is parallel to said third edge;

ii. a hook part having 1. a backing part engaged with a portion of said first length piece, wherein said backing part extends along a portion of an exterior surface of said first length piece;

2. two adjustable hooks selectively engaged with said backing part, wherein a distance between said adjustable hooks may be varied, and wherein said two adjustable hooks engage a back side of said ladder such that said ceiling tile ladder attachment device is supported via said two adjustable hooks; and, 3. a first attachment part engaged with a first end of said backing part, wherein said first attachment part is positioned on an interior surface of said first length piece;

4. a second attachment part engaged with a second end of said backing part, wherein said second attachment part is position on said interior surface of said first length piece, wherein said hook part is selectively engaged attached to said wire rack body via said first and second attachment parts so that said backing part is parallel to a top edge of said first length piece;

c. removing said ceiling tile from said wire rack body through said opening; and, d. positioning said ceiling tile on a ceiling above said ladder.

2. The method according to claim 1 wherein said wire rack body is further defined as having a length of two feet.

3. The method according to claim 1 wherein said wire rack body is further defined as being constructed of metal.

4. The method according to claim 1 wherein said wire rack body is further defined as being constructed of a metal having a plastic coating.

5. The method according to claim 1 wherein said wire rack body is further defined as being constructed of a metal having a rubber coating.

6. A ceiling tile ladder attachment device comprising:

a. a wire rack body, wherein said ceiling tile is positioned in said wire rack body, said wire rack body comprising:

i. a rectangular base piece;

ii. a first length piece extending upward from said rectangular base piece on a first edge of said rectangular base piece;

iii. a second length piece extending upward from said rectangular base piece on a second edge of said rectangular base piece, wherein said second edge is parallel to said first edge;

iv. a side piece extending upward from said rectangular base pieces on a third edge of said rectangular base piece, wherein said third edge is perpendicular to said first and second edges; and, v. an opening adjacent a fourth edge of said rectangular base piece, wherein said fourth edge is parallel to said third edge;

b. a hook part having i. a backing part engaged with a portion of said first length piece, wherein said backing part extends along a portion of an exterior surface of said first length piece;

ii. two adjustable hooks selectively engaged with said backing part, wherein a distance between said adjustable hooks may be varied along a portion of a length of said backing part;

iii. a first attachment part engaged with a first end of said backing part, wherein said first attachment part is positioned on an interior surface of said first length piece; and, iv. a second attachment part engaged with a second end of said backing part, wherein said second attachment part is position on said interior surface of said first length piece, wherein said hook part is selectively engaged attached to said wire rack body via said first and second attachment parts so that said backing part is parallel to a top edge of said first length piece.

7. The ceiling tile ladder attachment device according to claim 6 wherein said wire rack body is further defined as having a length of two feet.

8. The ceiling tile ladder attachment device according to claim 6 wherein said wire rack body is further defined as being constructed of metal.

9. The ceiling tile ladder attachment device according to claim 6 wherein said wire rack body is further defined as being constructed of a metal having a plastic coating.

10. The ceiling tile ladder attachment device according to claim 6 wherein said wire rack body is further defined as being constructed of a metal having a rubber coating.

11. The ceiling tile ladder attachment device according to claim 6 wherein said two adjustable hooks are further defined as including a hook point at a terminal end.

* * * * *